United States Patent [19]

Müller

[11] 4,165,606

[45] Aug. 28, 1979

[54] DEVICE FOR THE AUTOMATIC OPERATION OF WEIGHT DRIVEN CLOCKS

[76] Inventor: Paul C. Müller, Herderstrasse 2, 9000 St. Gallen, Switzerland

[21] Appl. No.: 802,007

[22] Filed: May 31, 1977

[30] Foreign Application Priority Data

May 31, 1976 [CH] Switzerland ..... 006824/76

[51] Int. Cl.[2] ..... G04B 7/00

[52] U.S. Cl. ..... 58/46 R; 58/124

[58] Field of Search ..... 58/46 R, 46 W, 48, 123, 58/124, 116 R, 116 M, 29, 30, 31, 32, 2, 1 R, 23 R; 290/1 D; 242/86.5 R

[56] References Cited

U.S. PATENT DOCUMENTS 1,952,030 10/1931 Korfhage ..... 58/41 B 3,946,991 3/1976 Ericksson ..... 242/86.5 R

FOREIGN PATENT DOCUMENTS 334317 10/1904 France ..... 58/40

*Primary Examiner*—J. V. Truhe

*Assistant Examiner*—Leonard W. Pojunas, Jr.

*Attorney, Agent, or Firm*—Thomas W. Speckman

[57] ABSTRACT

An automatic winding device for weight driven clocks wherein the driving unit is contained inside a suspended winding weight, has a roller to wind a flexible pulling means upon and a motor within the suspended winding weight actuated by switch means in the zone of the lower end position and upper end position of the winding weight. The device of this invention provides desired traditional clock weight appearance while providing efficient, modern winding and adjusting of the clock.

13 Claims, 1 Drawing Figure

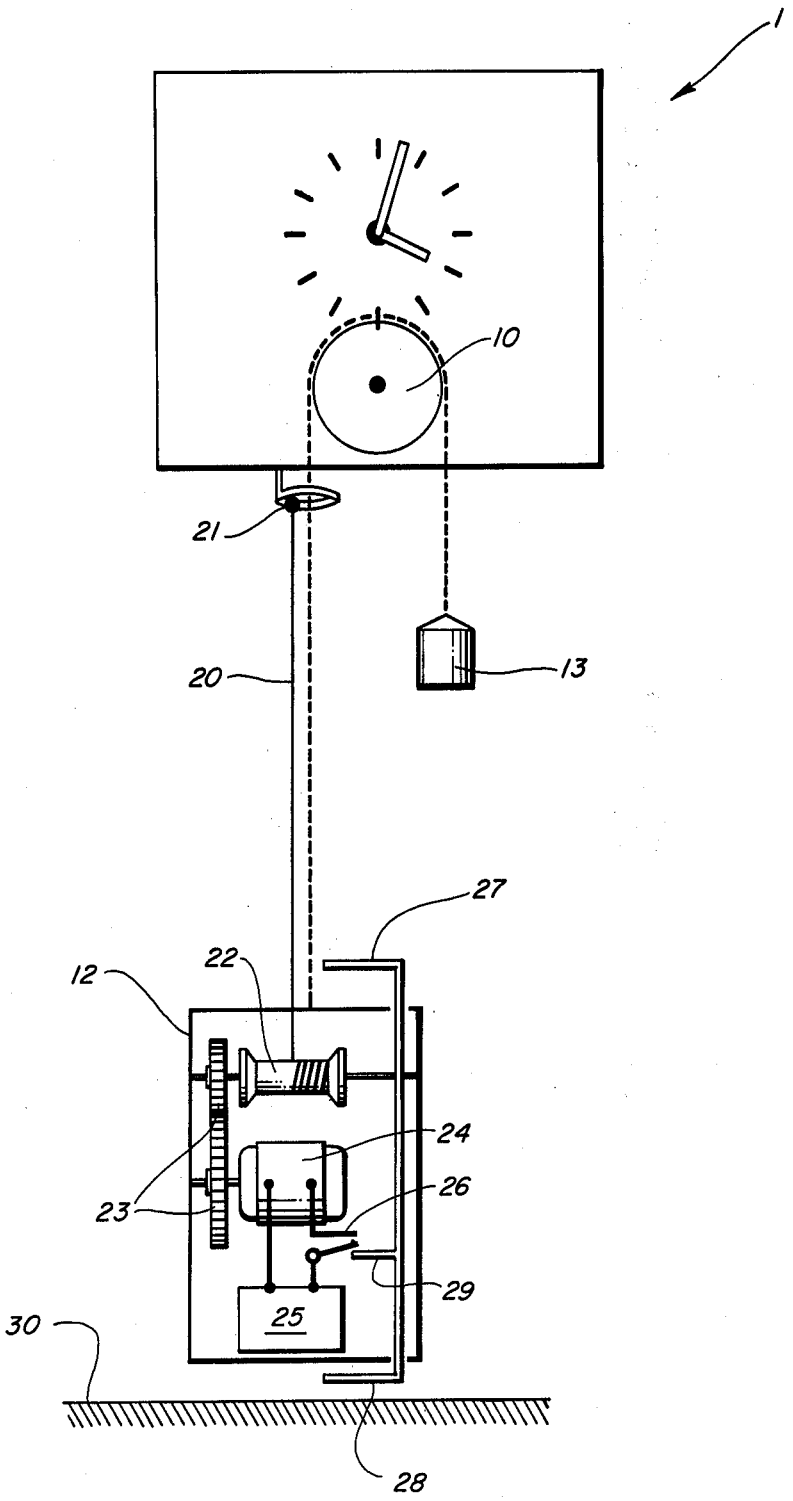
1
10
21
20
13
27
22
12
24
23
26
29
25
30
28

DEVICE FOR THE AUTOMATIC OPERATION OF WEIGHT DRIVEN CLOCKS

This invention relates to a device for the automatic winding of weight driven clocks having suspended winding weights by automating the periodic raising of the winding weights.

In spite of the accuracy, quiet running and easy servicing of modern electric and electronic clocks, weight driven period clocks are mostly wall clocks and clocks standing on the floor. They are frequently antique clocks, copies of old clocks, clocks continued to be built in the traditional style, folkloric clocks, such as Black Forest—Cuckoo clocks. Besides their actual function of telling time, these clocks serve also as decoration and especially the suspended weights are effective as decorating elements. Compared to electric and electronic clocks which do not require periodic attention, such as winding, weight driven clocks have the disadvantage that, depending on the construction and type of clock, the weights must be wound or returned to their upper position by hand, daily or weekly. One frequently forgets the winding and the clock stops. This disadvantage has been recognized and proposals for its elimination have been made.

One attempt to eliminate this disadvantage concerning the servicing or winding is disclosed by U.S. Pat. No. 1,194,928 teaching a device for winding weight driven clocks which has, in place of the weight, a housing on which the clock is firmly mounted. In the housing a box-like element with a built-in motor and laterally contacting current collectors winds itself upward periodically on the weight chain. Recently, "weight clocks" have been made which are weight driven clocks in outward appearance only. They are ordinary electric clocks where the weights are present solely as decorative elements without any technical function and where a decorative pendulum driven by an electric clock mechanism may wing back and forth. Such electric clocks can be characterized as false "weight driven" clocks and do not satisfy the standards of clockmaking art in any way since the mechanical elements are robbed of their true function.

The proposal of U.S. Pat. No. 1,194,928 suggests an undesired exterior change because the suspended weights are eliminated and replaced by a box.

It is an object of this invention to provide a device on a weight driven period clock with suspended weights which automates the winding and retains the mechanical functioning method and the appearance of the weight driven clock so that, in spite of the automation, the character of the weight driven clock is fully preserved.

This is achieved by placing a driving unit with an electric motor inside a suspended winding weight in such a way that the driving unit has a roller to wind a flexible pulling means which runs approximately parallel to the chain and is held in the zone of the clock mechanism. A switch turns on the motor in the zone of the lower end position of the winding weight and turns off the motor in the zone of the upper end position of the weight. The limit switches may be operated electromagnetically by a timer or by sensing means in the clockwork of the weight driven clock. The motor may be actuated by measuring the rotations of the roller upon which the pulling means is wound. The motor may also be actuated by a timer such as a quartz clockwork located within the winding weight.

A favorable further development of the invention has the purpose to correct periodically the faulty accuracy of older weight driven clocks or of their imitations.

Moreover, high-class weight driven clocks can be adjusted periodically to the accuracy of modern horological technique without a change of the character of the weight driven clock. For this purpose, there can be built into the winding weight a quartz clockwork which actuates a mechanical adjusting device to set the hands by way of the pulling means. As in modern clocks, the winding mechanism and hand adjustment may be operated off the same shaft, such as by electromechanical engagement.

In the FIGURE, the invention is shown in detail with respect to the example of a wall clock.

As on conventional weight driven clocks, the chain wheel 10 is driven by a weight 12 on chain 11 which is provided with counterweight 13. The weight 12 moves between the two end positions 21 and 30. In weight 12 there is a battery 25, possibly rechargeable, an electric motor 24 with gear 23 to drive roller 22. The roller 22 serves to coil and uncoil the pulling means 20, one end of which is fastened on the clock at chain guide 21 or on the wall.

When the weight 12 reaches end position 30, motor 24 is put into operation by way of contact element 28 and switch 26 and the weight begins to rise since pulling means 20 is wound on roller 22. When weight 12 reaches the upper end position 21, the motor is turned off by way of contact means 21 and switch 26 and roller 22 may be disconnected. In case no roller disconnecting coupling is provided, the motor can turn backwards while turned off.

The pulling means 20 is always held under tension by means of a torsion spring acting on the roller so that the pulling means will be wound even if weight 12 is raised manually. The auxiliary pulling force of the spring shall be slight with respect to weight 12 so that weight 12 is essentially fully available to drive the clock.

Besides the automation, this invention brings about the additional advantage that by equipping a single weight with a motor the other weights can also be wound since the pulling means is no longer held firmly in the zone of the clockwork but is guided to the next weight by way of guide rollers.

The pulling means may be a cord, thread or wire. The pulling means may serve as an electric donductor for charging the battery or supplying electricity to the motor.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. In a weight driven clock having a freely hanging winding weight, the improvement comprising; an automatic winding device comprising a driving unit inside said hanging winding weight, said driving unit having an electric motor driving a roller, said roller winding one end of a flexible pulling means, the other end of said pulling means held in the zone of the clock mechanism, and switch means actuating said motor in the zone of the lower position of the winding weight and deactuating said motor in the upper position of the winding weight thereby raising said winding weight from said lower position to said upper position.

2. Device as defined in claim 1 wherein the pulling means is a cord, thread or a wire.

3. Device as defined in claim 1 wherein the pulling means is held constantly under tension by means of a torsion spring acting on the roller to make possible pulling up the weight manually.

4. Device as defined in claim 1 wherein the pulling means is provided with stops to actuate limit switches in order to turn on and turn off the motor.

5. Device as defined in claim 1 wherein switching means is operated electromagnetically by a timer or by the clockwork of the weight driven clock.

6. Device as defined in claim 1 wherein the switching means is actuated by measuring the number of rotations of the roller.

7. Device as defined in claim 1 wherein the switching means is actuated by a contact element which touches on the housing of the clock in the upper position.

8. Device as defined in claim 1 wherein into the winding weight there is built a timer, especially a quartz clockwork which turns on the motor periodically in order to raise the weight and bring about winding of the weight driven clock.

9. Device as defined in claim 1 wherein a mechanical means to set the hands is actuated by the pulling means.

10. Device as defined in claim 1 wherein the device to set the hands is operated electro-magnetically.

11. Device as defined in claim 1 wherein a counterweight is attached to the free end of the chain to hold the chain taut during mechanical winding.

12. Device as defined in claim 1 wherein said suspended winding weight is the hollowed out original winding weight.

13. Device as defined in claim 1 wherein said pulling means is an electric conductor for charging a battery or supplying the motor.

* * * * *